US009803814B2

(12) United States Patent
Grant

(10) Patent No.: US 9,803,814 B2
(45) Date of Patent: Oct. 31, 2017

(54) LIGHTING HOUSING ASSEMBLY

(71) Applicant: Rick Grant, Brush Prairie, WA (US)

(72) Inventor: Rick Grant, Brush Prairie, WA (US)

(73) Assignee: O'RYAN INDUSTRIES, INC., Vancouver, WA (US)

( * ) Notice: Subject to any disclaimer, the term of this patent is extended or adjusted under 35 U.S.C. 154(b) by 107 days.

(21) Appl. No.: 14/843,842

(22) Filed: Sep. 2, 2015

(65) Prior Publication Data

US 2017/0059102 A1 Mar. 2, 2017

(51) Int. Cl.

| | |
|---|---|
| ***F21S 8/02*** | (2006.01) |
| ***F21V 21/04*** | (2006.01) |
| *F21Y 115/10* | (2016.01) |

(52) U.S. Cl.

CPC ..... *F21S 8/026* (2013.01); *F21V 21/047* (2013.01); *F21Y 2115/10* (2016.08)

(58) Field of Classification Search

CPC .. F21S 8/02; F21S 8/026; F21V 21/04; F21V 21/041; F21V 21/047–21/049

USPC ..... 362/365

See application file for complete search history.

(56) References Cited

U.S. PATENT DOCUMENTS

| | | | | |
|---|---|---|---|---|
| 2010/0039829 | A1* | 2/2010 | Tsai | F21S 8/026 362/373 |
| 2010/0128491 | A1* | 5/2010 | Hashimoto | F21S 8/026 362/365 |
| 2012/0182744 | A1* | 7/2012 | Santiago | F21S 8/026 362/365 |
| 2013/0120963 | A1* | 5/2013 | Holland | F21V 7/0066 362/84 |
| 2015/0338077 | A1* | 11/2015 | Johnson | F21V 23/005 362/234 |

* cited by examiner

*Primary Examiner* — Andrew Coughlin
*Assistant Examiner* — Keith Delahoussaye
(74) *Attorney, Agent, or Firm* — Schaffer IP Law, LLC

(57) ABSTRACT

A recessed lighting fixture, comprising a non-metallic housing having a central opening adapted to receive an LED lamp therethrough. The housing is formed of a front-facing trim ring surrounding the central opening and a rear portion coupled to a rear of the trim ring about the LED lamp. The rear portion includes at least two peripheral flanges that extend backward from the trim ring and terminate in a spring-clip support. A spring clip is coupled to each of the spring clip supports and is rotatably biased toward a front of the housing to bear against a backside of a recessed opening when the housing is inserted into the recessed opening and when the trim ring bears against a frontside of the recessed opening.

14 Claims, 4 Drawing Sheets

LIGHTING HOUSING ASSEMBLY

BACKGROUND OF THE INVENTION

1. Field of the Invention

This invention relates generally to lighting fixtures and, more particularly, to an LED lighting fixture formed of non-metallic materials.

2. Description of the Prior Art

Recessed lighting fixtures are well known in the art. Ideally, such fixtures are designed to be visually unobtrusive in that very little of the lighting fixture is visible from below the ceiling. However, some trim portions are visible as well as the light sources. An opening is cut into the ceiling into which most of the lighting fixture is mounted so that very little extends below the plane of the ceiling. A trim piece or trim ring, which may take the form of a bezel, is generally located at the opening to enhance the appearance of the light fixture and conceal the hole cut into the ceiling. Typically, the trim piece is slightly below the planar surface of the ceiling.

The lighting used in such conventional recessed fixtures is typically incandescent or, more recently, halogen-based lamps. Such lamps put out a tremendous amount of heat is just a small space and thus heat dissipation is an important consideration. As a result the materials used for the fixture and primarily the housing enclosing the lamp is metal which is relatively expensive, heavy, and prone to rust. Metal has other distinct disadvantages in that it must be painted to color match the décor in the environment used, and any rust leaves unsightly stains on the ceiling or wall where it is used.

Progress has produced various lamp options including LED which provide efficient lighting in small packages, and having different thermal properties than hot halogen lighting.

Accordingly, the need remains for recessed housing assemblies that can accommodate these various options that also address some of the disadvantages of using solely metallic fixtures.

SUMMARY OF THE INVENTION

A recessed lighting fixture, comprising a non-metallic housing having a central opening adapted to receive an LED lamp therethrough. The housing is formed of a front-facing trim ring surrounding the central opening and a rear portion coupled to a rear of the trim ring about the LED lamp. The rear portion includes at least two peripheral flanges that extend backward from the trim ring and terminate in a spring-clip support. A spring clip is coupled to each of the spring clip supports and is rotatably biased toward a front of the housing to bear against a backside of a recessed opening when the housing is inserted into the recessed opening and when the trim ring bears against a frontside of the recessed opening.

Alternate aspects of the invention also comprise a recessed lighting fixture that includes an LED lamp having a light emitting face and a conical body rearward of the light emitting face with heat dissipating surfaces formed thereon. The fixture includes a non-metallic housing assembled around the LED lamp having a central opening into which the LED lamp is received. An annular trim ring surrounds the emitting face of the LED lamp. Rearwardly projecting flanges are spaced from the heat dissipating surfaces of the LED lamp conical body. A retaining clip bears against the LED lamp and non-metallic housing to retain the LED lamp within the central opening.

The foregoing and other objects, features and advantages of the invention will become more readily apparent from the following detailed description of a preferred embodiment of the invention that proceeds with reference to the accompanying drawings.

DETAILED DESCRIPTION

Figure 1:
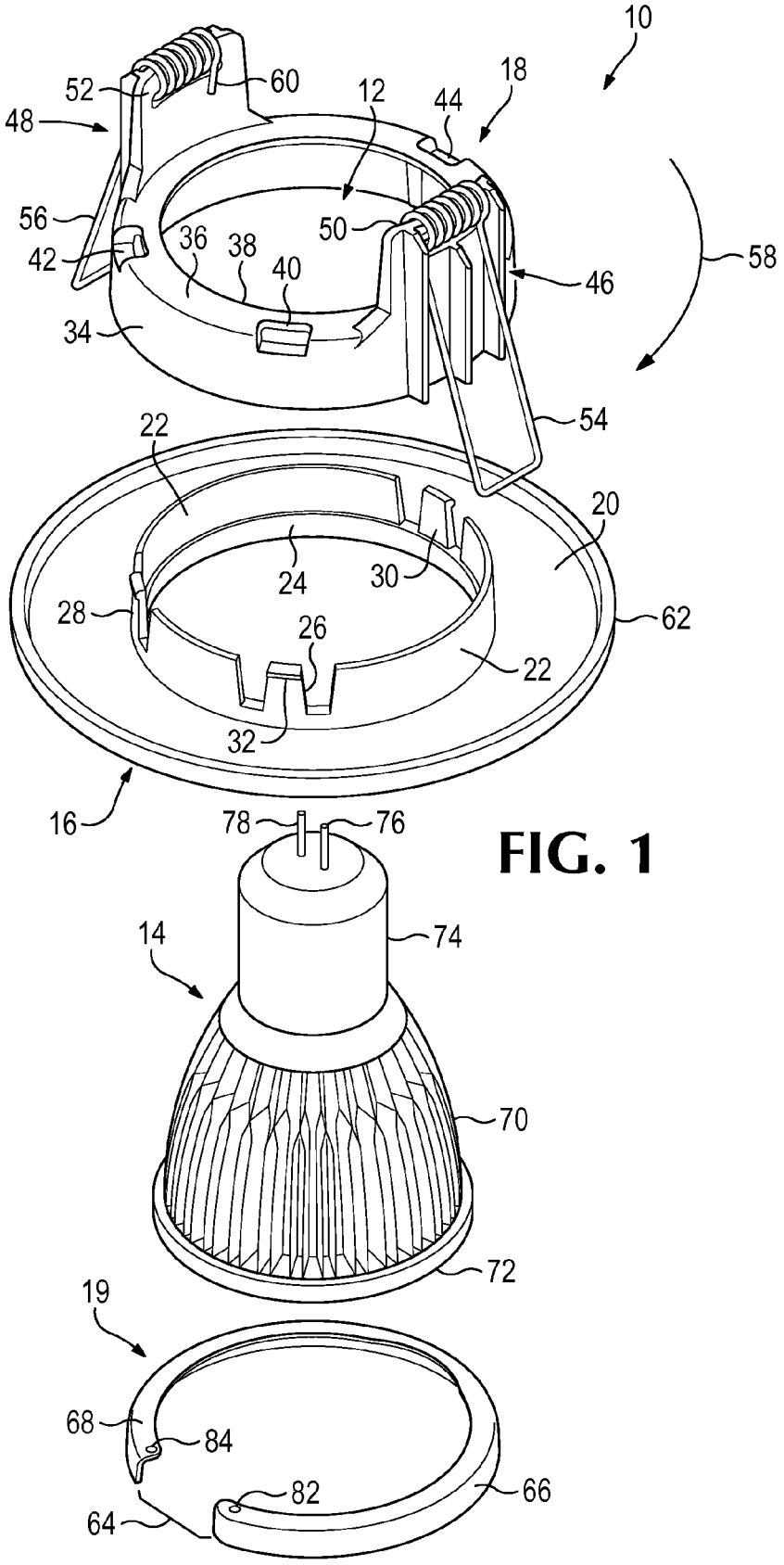
FIG. 1 is an exploded, perspective view of the recessed lighting assembly constructed according to a preferred embodiment of the invention.
Figure 2:
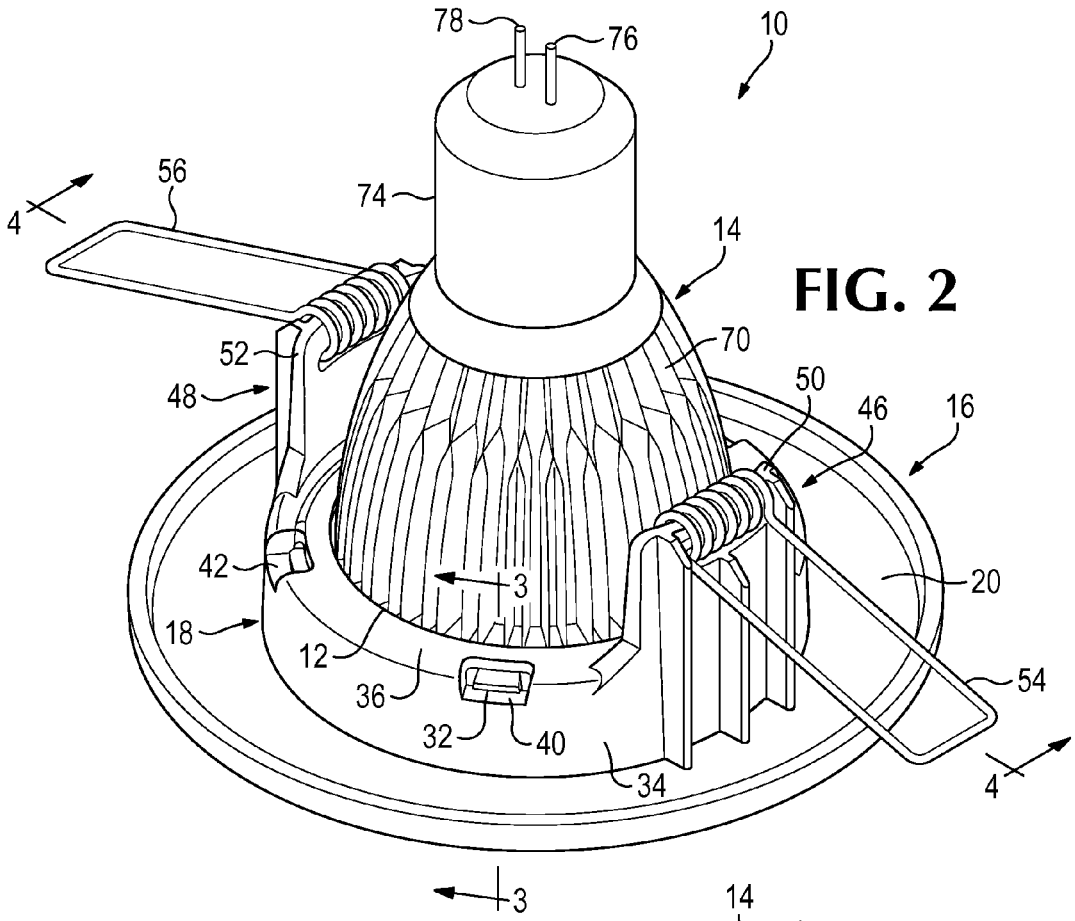
FIG. 2 is a perspective view of the recessed lighting assembly of FIG. 1 in assembled form.

FIGS. 1 and 2 show a recessed lighting fixture 10 comprising a non-metallic housing having a central opening 12 adapted to receive an LED lamp 14 therethrough. The housing is formed of a front-facing trim ring 16 and a rear portion 18 disposed along and about the central opening 12. The rear portion 18 is releasably coupled to a rear of the trim ring 16, as in the embodiment shown and described further below, so that the housing may be assembled around the LED lamp 14 received within the central opening 12. In general, the trim ring 16 and rear portion 18 form the housing of the lighting fixture and may further include a retaining clip 19 to better retain the LED lamp 14 within the housing as described below with reference to FIGS. 3 and 4.

Trim ring 16 includes an annular expanse or plate 20 adapted to provide a decorative element that extends over and completely covers a hole 100 (FIG. 4) made in the wall or ceiling 102 to receive the housing. The decorative plate 20 can be stained, painted, or integrally formed with a particular color as desired to match the wall or ceiling color or a particular desired décor. Annular flange 22 extends rearwardly from a backside of the trim ring plate 20 and surrounds central opening 12. The annular flange 22 includes a lip within the central opening adjacent the front face of the trim ring, preferably formed as an annular ridge 24 that projects inward into the central opening 12 and having a diameter less than the inside diameter defined by the interior wall 34 of the annular flange 22.

Spaced about the periphery of the annular flange 22 and about the central opening 12 are tabs—such as tabs 26, 28, and 30—that extend upward and rearward generally within the plane of the annular flange. The tabs 26, 28, 30 are preferably spaced asymmetrically about annular flange 22 and configured to mate with complementary slots 40, 42, 44 formed within the rear portion 18 of the housing as described further below. Each of the tabs include a thickened projection—such as projection 32 on tab 26—formed on the terminal end of the tab that helps to lock the tab in place within a corresponding slot when the trim ring and rear portion are coupled together.

Figure 4:
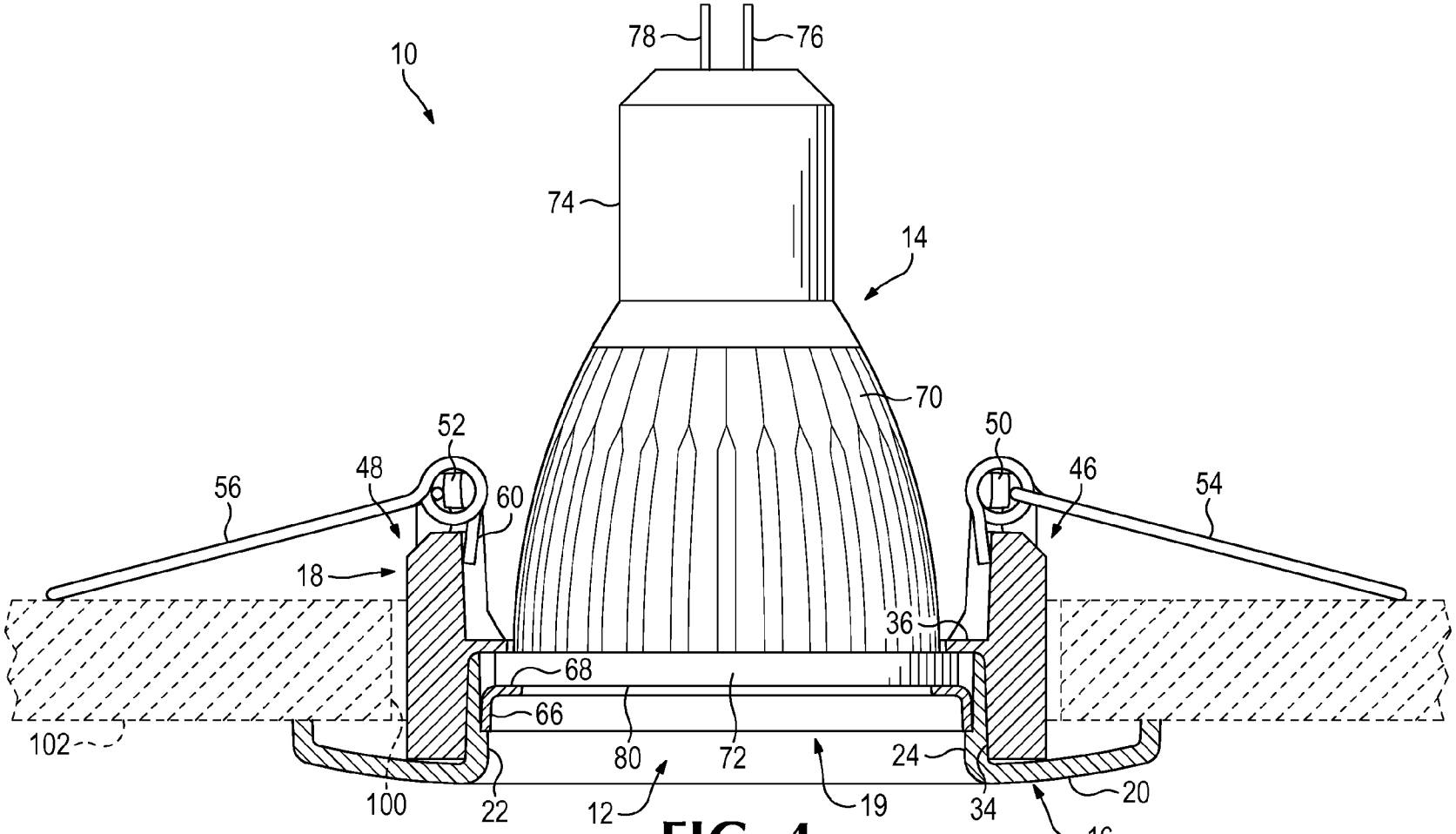
FIG. 4 is a side-elevation view taken along line 4-4 of the lighting assembly of FIG. 2 installed within a ceiling recess shown in section.

The rear portion 18 of the housing includes annular side walls 34 sized to a diameter greater than the annular flange 22 of the trim ring 16 so that the rear portion can slide over the annular flange. A back wall 36 of the rear portion 18 has a rear opening 38 with a diameter less than an inside diameter defined by the interior wall 26 of flange 22. In this way, the LED lamp 24 may be received through the front of the housing through central opening 12 defined in the trim ring 16 front face (e.g. the front-side of plate 20) and be retained against the annular back wall 36 of the rear portion 18 of the housing while still allowing the long barrel (e.g. the heatsink 70 and the base 74) of the LED lamp to extend out the rear end of the housing as shown in FIGS. 2 and 4.

The rear portion 18 includes slots—such as slots 40, 42, and 44—defined within the rear portion of the housing that are configured to receive the corresponding tabs 26, 28, 30 therethrough in order to couple the trim ring 16 and rear portion 18 together. The slots 40, 42, 44 are spaced asymmetrically about the rear portion to match the locations of the corresponding tabs 26, 28, 30. In the embodiment shown, for instance, slots 40 and 42 are spaced closer to one another and further away from slot 44. In this way, the trim ring 16 and rear portion 18 may be rotationally locked while also ensuring that the parts are properly oriented with respect to one another. The slots 40, 42, 44 are formed at the intersection where the side wall 34 and back wall 36 of the rear portion 18 meet with a width that matches that of the respective tab and a depth equivalent to the tab but less than the terminal end 32 of the tab. When the tab is received within the slot 40, therefore, the terminal end 32 snaps over the lip of the slot and mechanically retains the tab within the slot to supplement the friction-fit coupling of the trim ring with the rear portion. Although the tabs and slots shown have identical widths, it is understood that the spacing and sizes may be varied without departing from the spirit of the invention.

The rear portion further includes at least two rearwardly-extending peripheral flanges 46, 48 disposed on opposed sides of the central opening 12. Each peripheral flange 46, 48 terminates in a spring-clip support 50, 52. A spring clip 54, 56 is coupled to a respective spring clip support 50, 52 and rotatably biased 58 toward a front of the housing as described further below with reference to FIG. 4. Rotational bias is maintained within the spring clip by wrapping metal wire about a post, such as wire 56 about the support 52, so that the spring portion rotates except for a terminal end, here terminal wire end 60. Since terminal end 60 of spring clip 56 is prevented from rotating on the support 52, the spring clip assembly is biased downward toward a rest position against the peripheral edge 62 of the trim ring plate 20.

Figure 3:
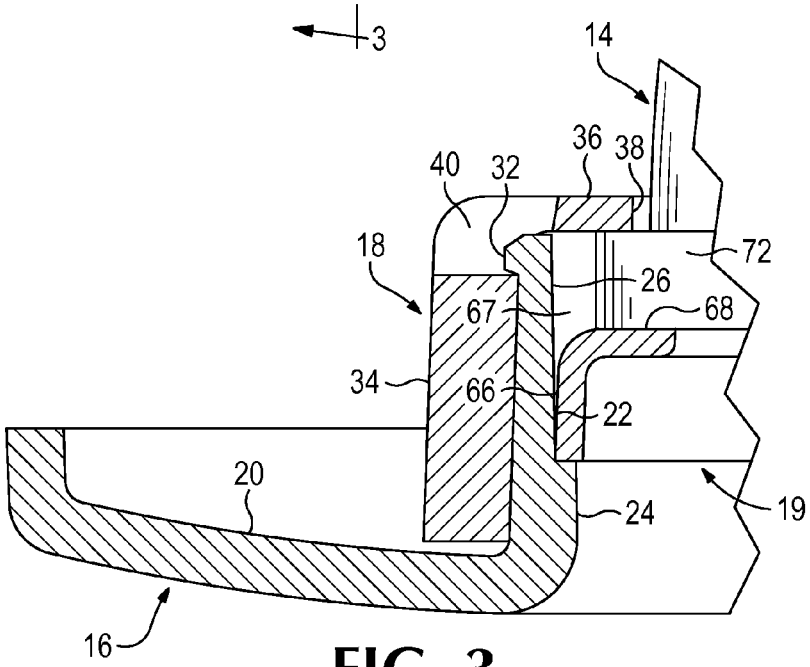
FIG. 3 is a magnified side-elevation section view taken along line 3-3 of the lighting assembly of FIG. 2.

FIG. 3 illustrates a close-up of the assembled lighting assembly 10 where trim ring 20 is mated to the rear portion 18 to form the lighting assembly housing. A retaining clip 19 is shown inserted between the annular ridge 24 formed on the inside of the trim ring flange 22 and a rim 72 of the LED lamp 14. Clip 19 comprises a notched 64 annular body biased to a diameter slightly greater than the inside diameter of the annular flange 22 of the trim ring 16. The clip body is formed with an L-shaped cross-section and includes a side wall 66 vertically sized to leave a gap 67 when received between the lip of the annular flange 24, and back wall 68 of the rear portion extending inward into the central opening 12 so that a proximal portion of the LED lamp, e.g. a rim 72, may be retained snuggly within the gap. In use, the retaining clip 19 includes a bottom surface that rests against the ridge 24 lip so that side wall 66 bears against the interior wall of the annular flange 22.

The LED lamp 14 is of a conventional MR-16 type and includes a heatsink 70 terminating in an annular rim 72 screwed to the front end of the heatsink. The heatsink includes a plurality of metallic fins extending along the surface of the heatsink that are adapted to radiate the heat generated from operation of the LED lamp 14. The rim 72 has a greater diameter than the heatsink 70 and its included radiator fins. The lighting assembly 10, and particularly the ridge 24 within the trim ring 16 and the back wall 36 of the rear portion 18, are dimensioned to retain the rim 72 and retaining clip 19 between them as shown best in FIG. 3.

Coupled to the rear of the heatsink 70 is a cylindrical base 74 into which the electronics assembly (not shown) is installed. Power pins 76, 78 extend out the back end of the LED lamp base 74 and are adapted to be coupled to complementary power plugs wired within the ceiling cavity into which the lighting assembly is installed. A light assembly, such as LEDs 86, are installed within a cavity formed within the heat sink 70 at the front of the light and face forward to project out the central opening 12 formed within the trim ring 16. Power supplied through pins 76, 78 then operates to power the LEDs 86, whose operate heats up the entire LED lamp 14 with the heat radiated out of the fins on the heatsink 70.

FIG. 4 shows the LED lamp 14 installed within the lighting assembly 10. The LED lamp 14 includes a light emitting face 80 and a conical body rearward of the light emitting face with heat dissipating surfaces 70 formed thereon. A non-metallic housing assembled around the LED lamp, including trim ring 16 and rear portion 18, has a central opening 12 into which the LED lamp 14 is received. The annular trim ring 16 surrounds the emitting face 80 of the LED lamp 14 and rearwardly projecting flanges 46, 48 are spaced from the heat dissipating surfaces 70 of the LED lamp conical body. The retaining clip 19 bears against the LED lamp 14 and non-metallic housing to retain the LED lamp within the central opening 12. Spacing of the LED lamp 14 from the non-metallic sections of the housing assembly are important to allow adequate heat dissipation. The efficiency of modern LED lamps 14 make the temperature surrounding the lamp lower than with normal incandescent or halogen bulbs, then enabling use of different materials for the housing such as a polycarbonate plastic or other non-metallic materials that may be approved for use in such fixtures by UL or other certification agencies.

When installed within a hole 100 formed in a wall or ceiling 102, the trim ring flange 22 portion of the trim ring 16 and rear portion 18 are first coupled together into a housing assembly. The spring clips 54, 56 are then rotated upward so that both can fit through the hole 100 and into the cavity within the ceiling and the housing assembly pushed through. The spring clips 54, 56 then rotate downward on either side of the housing assembly until they make contact with the backside of the ceiling 102 drywall. The trim ring plate 20 is then pushed up against the frontside of the ceiling so that the housing assembly is retained between them. A wired connector assembly (not shown) is then pulled down from within the ceiling cavity through the central opening 12 of the housing assembly and coupled to complementary pins 76, 78 on the LED lamp 14. The lamp 14 is then pushed through the central opening 12 until the rim 72 of the lamp 14 contacts the back wall 36 of the housing assembly. The retaining clip 19 is then compressed via the notch 64 and inserted through the central opening and allowed to expand into the gap 67 formed between the trim ring ridge 24 and the rear wall 36 of the housing assembly to thereby lock the LED lamp 14 into place and prevent it from falling out. If the LED lamp 14 burns out and needs to be replaced, the last few steps are reversed where the retaining clip 19 is removed and the lamp 14 allowed to fall out of the opening, whereupon it is disconnected from power and a new lamp installed. To facilitate removal of the retaining clip 19, holes 82, 84 are formed in terminal ends of the notch 64. A tool may insert into each of the holes 82, 84 and pulled together to reduce the dimension of the clip and allow it to be removed.

Figure 5:
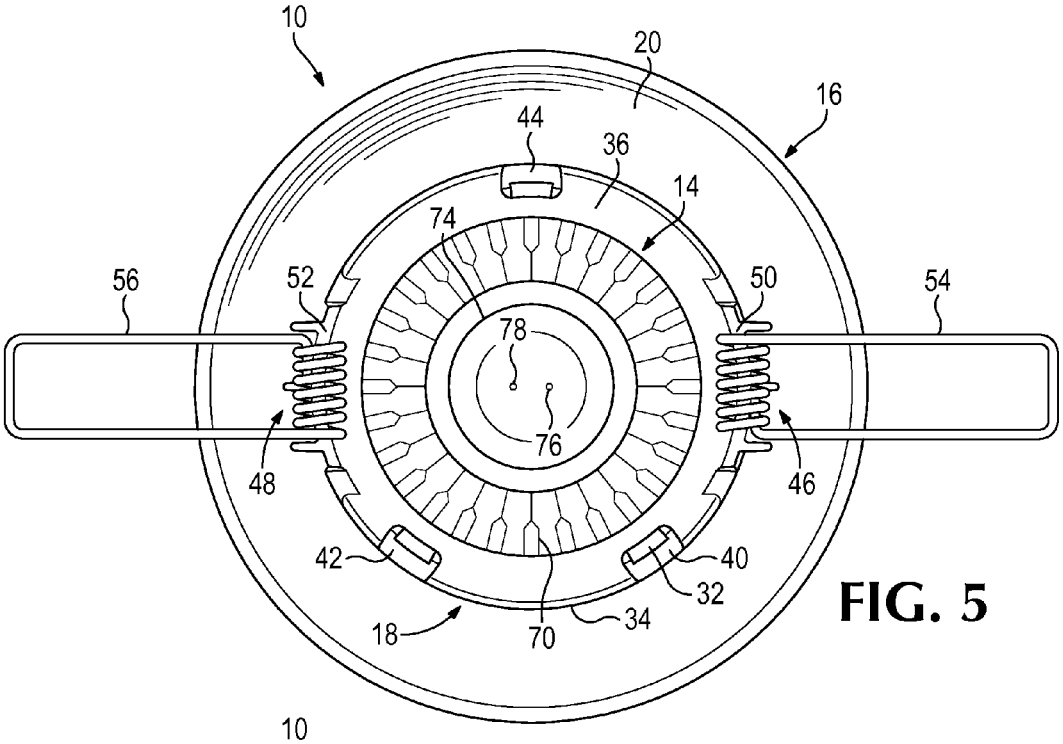
FIG. 5 is a backside plan view of the lighting assembly of FIG. 2.
Figure 6:
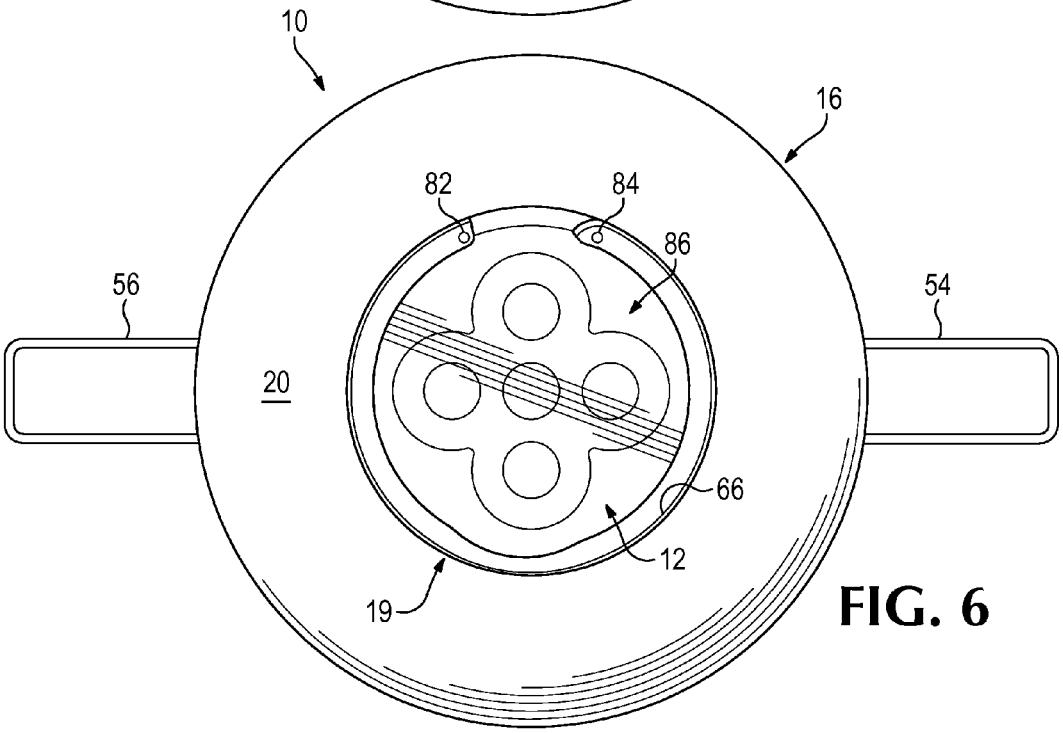
FIG. 6 is a frontside plan view of the lighting assembly of FIG. 2.

FIGS. 5 and 6 illustrate back and front plan views respectively on the recessed lighting fixture 10 with the LEDs 86 visible on the front-facing view illustrating how the retailing clip 19 holds the LED lamp 14 within the central opening 12 formed through the housing assembly.

Having described and illustrated the principles of the invention in a preferred embodiment thereof, it should be apparent that the invention can be modified in arrangement and detail without departing from such principles. I claim all modifications and variation coming within the spirit and scope of the following claims.

What is claimed is:

1. A recessed lighting fixture, comprising:

a non-metallic housing having a central opening adapted to receive an LED lamp therethrough, the housing formed of a front-facing trim ring and a rear portion disposed along and about the central opening, the rear portion being releasably coupled to a rear of the trim ring so as to be assembled around the LED lamp received within the central opening, wherein the rear portion includes at least two rearwardly-extending peripheral flanges on opposed sides of the central opening that each terminate in a spring-clip support;

a spring clip coupled to each of the spring clip supports and rotatably biased toward a front of the housing so as to bear against a backside of a recessed opening of a wall or ceiling when the housing is inserted into the recessed opening of the wall or ceiling so that the trim ring bears against a front side of the recessed opening;

an annular flange extending rearwardly from a back side of the trim ring and surrounding the central opening, wherein the annular flange includes a lip within the central opening adjacent the front face of the trim ring;

annular side walls of the rear portion adapted to receive the annular flange of the trim ring when the trim ring and rear portion are assembled together; and a back wall of the rear portion having a rear opening with a diameter less than an inside diameter defined by an interior wall of the annular flange, the recessed lighting fixture housing being configured so that an LED lamp is received through a front face of the trim ring through the central opening and retained against the back wall.

2. The recessed lighting fixture of claim 1, further including a retaining clip received between the lip and the back wall of the rear portion, the retaining clip configured to retain an inserted LED lamp within the housing.

3. The recessed lighting fixture of claim 2, wherein the retaining clip comprises a notched annular body biased to a diameter slightly greater than the inside diameter of the annular flange of the trim ring, the retaining clip having a bottom surface resting against the lip and a side wall bearing against the interior wall of the annular flange, the side wall being vertically sized to leave a gap when received between the lip of the annular flange and back wall of the rear portion so that a proximal portion of the LED lamp is retained within the gap.

4. The recessed lighting fixture of claim 1, wherein the non-metallic housing is formed of plastic.

5. The recessed lighting fixture of claim 4, wherein the plastic is polycarbonate.

6. The recessed lighting fixture of claim 1, further including:

tabs located about the central opening and on an annular flange formed on the rear of the trim ring; and slots defined within the rear portion of the housing and configured to receive the tabs therethrough to couple the trim ring and rear portion together.

7. The recessed lighting fixture of claim 6, wherein the tabs are formed asymmetrically about the annular flange.

8. The recessed lighting fixture of claim 6, the tabs including a projection formed on a terminal end of the tabs to snap fit into the slots.

9. The recessed lighting fixture of claim 1, wherein the lip is adjacent a front face of the trim ring and projects inwardly into the central opening to form an annular ridge having a diameter less than the inside diameter defined by the interior wall of the annular flange.

10. A recessed lighting fixture, comprising:

an LED lamp having a light emitting face and a conical body rearward of the light emitting face with heat dissipating surfaces formed thereon;

a non-metallic housing assembled around the LED lamp and having a central opening into which the LED lamp is received, an annular trim ring surrounding the light emitting face of the LED lamp, a lip extending into the central opening, and rearwardly projecting flanges spaced from the heat dissipating surfaces of the LED lamp conical body; and a retaining clip supported on the lip and bearing against the LED lamp and the non-metallic housing to retain the LED lamp within the central opening.

11. The recessed lighting fixture of claim 10, further comprising a plurality of tabs and slots spaced about the central opening and configured to enable the non-metallic housing to be assembled about the LED lamp.

12. The recessed lighting fixture of claim 11, wherein the tabs are asymmetrically spaced about the central opening and the slots aligned with the asymmetrically spaced tabs to receive said tabs therein.

13. The recessing lighting fixture of claim 10, further including a spring clip coupled to terminal ends of each of the rearwardly projecting flanges and rotatably biased toward a front of the housing to bear against a back side of a recessed opening when the housing is inserted into the recessed opening and the trim ring bearing against a front side of the recessed opening.

14. A recessed lighting fixture, comprising:

a non-metallic housing having a central opening passing completely through the housing and adapted to receive an LED lamp therethrough, the housing formed of a front-facing trim ring having a lip extending into the central opening and a rear portion disposed along and about the central opening, the rear portion being releasably coupled to a rear of the trim ring so as to be assembled around the LED lamp received within the central opening and configured to allow a rear of the LED lamp to extend out a rear end of the housing so that a heatsink on the LED lamp is exposed, wherein the rear portion includes at least two rearwardly-extending peripheral flanges on opposed sides of the central opening that each terminate in a spring-clip support;

a spring clip coupled to each of the spring clip supports and rotatably biased toward a front of the housing so as to bear against a backside of a recessed opening of a wall or ceiling when the housing is inserted into the recessed opening of the wall or ceiling so that the trim ring bears against a front side of the recessed opening.

* * * * *